United States Patent [19]

Hamamura et al.

[11] 4,241,111

[45] Dec. 23, 1980

[54] PROCESS FOR CONSECUTIVELY COATING BOTH SIDES OF WEB

[75] Inventors: Ken Hamamura; Masuo Kabutomori; Eiichi Ohta, all of Fujinomiya; Hiroki Saito, Minami-ashigara, all of Japan

[73] Assignee: Fuji Photo Film Co., Ltd., Minami-ashigara, Japan

[21] Appl. No.: 932,969

[22] Filed: Aug. 11, 1978

[30] Foreign Application Priority Data

Aug. 11, 1977 [JP] Japan ..... 52-96353

[51] Int. Cl.[3] ..... B05D 1/00; B05D 5/00

[52] U.S. Cl. ..... 427/211; 427/348

[58] Field of Search ..... 427/209–211, 427/348, 345

[56] References Cited

U.S. PATENT DOCUMENTS 3,496,005 2/1970 Ishiwata et al. ..... 117/34

3,533,833 10/1970 Takahashi et al. ..... 427/345

*Primary Examiner*—Bernard D. Pianalto

*Attorney, Agent, or Firm*—Sughrue, Rot well, Mion, Zinn and Macpeak

[57] ABSTRACT

A process for consecutively coating both sides of a continuously travelling web, which comprises coating a first coating solution onto a first side of a continuously travelling web to form a coated layer thereon, supplying a second coating solution while the coated layer on the first side of the travelling web is still in a non-dry state, using a bar which is supported by a supporting member and which rotates in contact with the web in the same direction as the travelling direction of the web in such a manner that a liquid pool of the second coating solution is formed immediately before the position where the bar comes into contact with the web while supporting the first coated side of the web with a pressurized gas, and applying the second coating solution to the second side of the web opposite to the first coated side using the bar.

5 Claims, 6 Drawing Figures

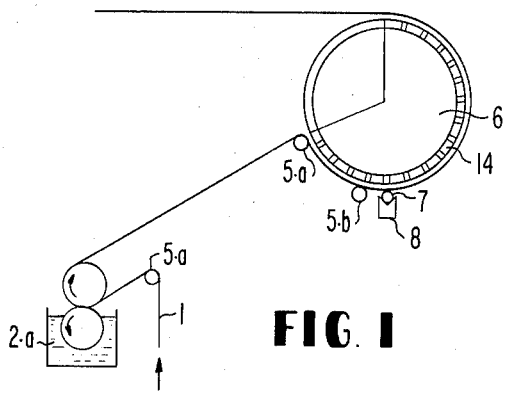
FIG. 1
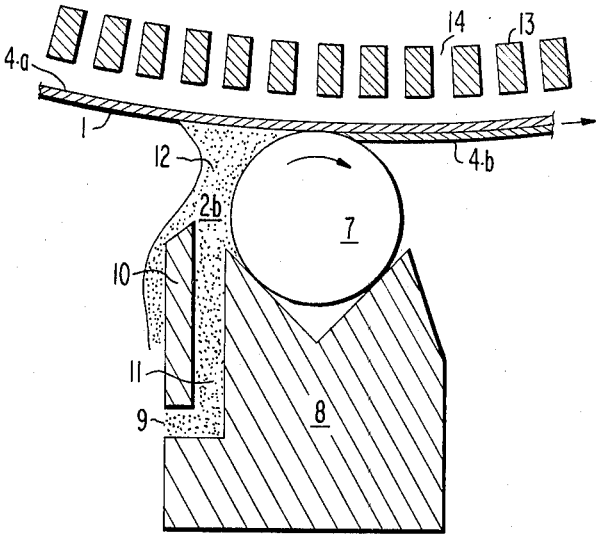
FIG. 2
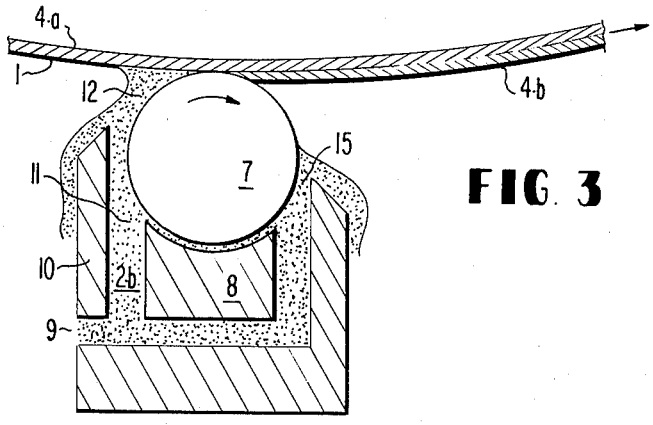
FIG. 3
FIG. 5-a
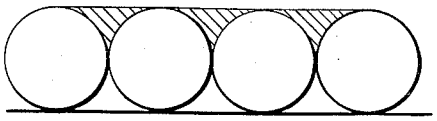
FIG. 4
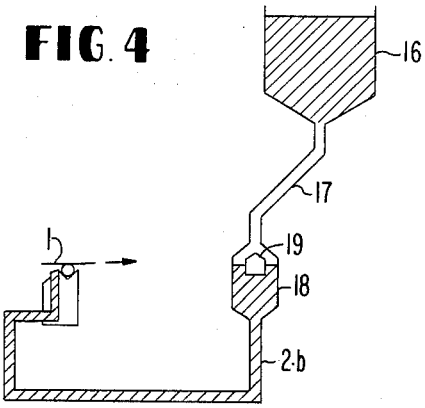
FIG. 5-b
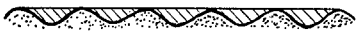

PROCESS FOR CONSECUTIVELY COATING BOTH SIDES OF WEB

BACKGROUND OF THE INVENTION

1. Field of the Invention

The present invention relates to a coating process. More particularly, it relates to a process for consecutively coating both sides of a continuously travelling band-shaped support (hereinafter referred to as a "web"), which comprises applying a coating solution to the one side of the web, and applying another coating solution to the other side of the web while the first coating layer is still in a non-dry state.

2. Description of the Prior Art

In the process of consecutively coating both sides of a web by providing a coating layer on the one side thereof and applying another coating layer to the other side of the web while the first coating layer still is in a non-dry state, the second coating must be conducted, after providing the first coating layer, without disturbing the first coating layer.

A process for satisfying such requirements for consecutive coating of both sides of a web, which has been suggested, is a gas-supporting coating process wherein the second coating is conducted while supporting the first coated side of a web in a non-contact manner (e.g., as disclosed in Japanese Patent Publication Nos. 17,853/74, 38,737/76, etc.). In these processes, second coating is conducted by bead coating, extrusion coating, etc. while supporting the first coated side of a web with the pressure of a gas flow. However, no matter how accurately the gas pressure may be controlled, it is extremely difficult to avoid minute vibrations of the web position due to change in gas pressure, etc. Therefore, various problems have occurred. For example, in bead coating, extrusion coating or the like which has been used in combination with the technique of supporting a web by the pressure of a gas flow, the relative positionwise relationship between a coating apparatus and a web greatly influences the thickness of a coating layer, and hence minute vibrations as described above of the web position have naturally resulted in stepwise coating unevenness. Accordingly, the process of combining bead coating or extrusion coating with the technique of supporting a web with the pressure of a gas flow has not necessarily provided industrially satisfactory results.

To improve the conventional gas-supported coating process, it can be considered to conduct the second coating using a process which does not require the web to be backed up or supported; with a typical example of such a process being bar coating. In bar coating, a coating solution is applied in an excess amount to a web by kiss coating, and the excess coating solution is removed using a wire bar or grooved bar, which is stationary or is intermittently or continuously rotated in an opposite direction to the travelling direction of the web at a slower peripheral velocity than the travelling velocity of a web to thereby meter the coating amount to a desired level. This process usually does not require the web to be backed up at the coating and metering sections. However, when a web is not well supported, this process also tends to generate stepwise coating unevenness or longitudinal streaks due to a flapping of or wrinkles in the web, and hence restraining rolls or the like are usually disposed in order to prevent the web from flapping and maintain the planar state of the web.

In the process of consecutively coating both sides of a web, however, it is difficult to support a web using restraining rolls or the like. Thus, in order to minimize flapping or wrinkling of the web in the coating section and metering section, it is considered necessary to support the web with a pressurized gas in the coating and metering sections. According to investigations which have now been made, it has been observed that, when bar coating is conducted while supporting a web with a pressurized gas, stepwise coating unevenness due to minute vibrations of the web position is reduced as compared with bead coating or extrusion coating, whereas intimate adhesion between the web and the coating roll is deteriorated particularly in the kiss coating section with longitudinal streaks being generated on the coated surface. Such longitudinal streaks may be attributed to longitudinal wrinkles formed on the web. That is, even the techniques of supporting the web with a gas under pressure fails to completely remove longitudinal wrinkles formed in a web. These longitudinal wrinkles are removed to a considerable extent in the bar-metering section, since a web tends to conform to the surface of the bar due to the small diameter of the bar, thus serious influences on the coated surface are not exerted. However, in the kiss coating section, a web conforms with difficulty to the surface of a coating roller since the diameter of the coating roller is much greater than that of a bar and, as a result, longitudinal wrinkles in a web are believed to be removed with difficulty and longitudinal streaks are formed on the coating layer. Further, when the technique of supporting the web with a gas under pressure is combined with the bar coating process, the web must be supported by a gas under pressure in both the kiss coating section and the bar metering section, and thus a large space is necessary. Therefore, this approach has not been employed industrially in consecutively coating both sides of a web.

SUMMARY OF THE INVENTION

An object of the present invention is to provide a process for consecutively coating both sides of a web with coating layers having excellent surface property.

The above-described object of the present invention is attained by the process of this invention which comprises coating a first coating solution onto a first side of a travelling web to form a coated layer, supplying a second coating solution, while the coated layer provided on the first side of the travelling web is still in a non-dry state, using a bar supported by a supporting member and rotating in contact with the web in the same direction as the travelling direction of the web in such a manner that a liquid pool of the second coating solution is formed immediately before the position where the bar comes into contact with the web while supporting the first coated side of the web with a pressurized gas, and applying the second coating solution to the second side of the web opposite to the first coated side of the web using the bar.

BRIEF DESCRIPTION OF THE DRAWINGS

FIG. 1 is a schematic view of a both sides-consecutive coating apparatus, showing one embodiment of the present invention.

FIGS. 2 and 3 are schematically illustrated views showing preferred examples of an improved bar coating apparatus for the second coating employed in embodiments of the present invention.

FIG. 4 is a schematic view of a liquid level-adjusting device to be used in one embodiment of the present invention.

FIGS. 5 (*a*) and (*b*) respectively show schematic cross sectional views of a wire bar and a grooved bar.

DETAILED DESCRIPTION OF THE INVENTION

The present invention will now be described in greater detail by referring to embodiments shown in the appended drawings.

FIG. 1 is a schematic view of one embodiment of the present invention showing an apparatus for consecutively coating both sides of a web, and FIG. 2 is an enlarged view of a second coating section.

In FIGS. 1 and 2, web 1 to be coated with a coating solution is fed to a first coating section at a definite velocity, and coating solution 2*a* is coated on one side of the web by roller coating device 3 to form first coating layer 4*a*. Web 1 carrying the first coating layer 4*a* is then fed to a second coating section while still in a non-dry state. Here 5*a* indicates a carrying roller. In the second coating section, second coating solution 2*b* is applied to the side of the web opposite to the first coated side of the web while supporting the first coating layer 4*a* side of the web in a non-contact manner using air cushion device 6, thus second coating layer 4*b* being formed. Numeral 7 indicates a wire bar or a grooved bar (hereinafter both being collectively referred to as a "bar") which is rotated in the same direction as the travelling direction of the continuously travelling web 1. Numeral 8 indicates a bar-supporting member which is provided over the full length of bar 7 and which functions to prevent bar 7 from bending and functions as a feeder for feeding coating solution 2*b* to bar 7. Coating solution 2*b* is fed through feeding opening 9 provided in bar-supporting member 8 into solution-guiding conduit 11 formed between dam member 10 and bar-supporting member 8, and picked up by rotating bar 7 to be coated on web 1. In this occasion, metering of coating solution 2*b* conducted at the place where web 1 and bar 7 come into contact with each other, and only a desired amount of the coating solution is applied to web 1, with excess solution flowing down to form liquid pool 12 together with freshly fed coating solution 2*b*. Therefore, under a steady state, coating solution 2*b* is applied to web 1 via liquid pool 12.

According to this process, no longitudinal wrinkles are observed on second coating layer 4*b*. This may be because, coating and metering are conducted using bar 7 having a small diameter in this process, with web 1 well fitting to the surface of bar 7 and, as a result, any longitudinal wrinkles formed by air cushion device 6 are overcome. In addition, this process reduces stepwise coating unevenness due to minute vibrations of the position of web 1 to a degree which is practically negligible. This may be because, in this process, the coating amount is decided mainly by the diameter of the wire or the pitch of the groove and the change in lap angle between web 1 and bar 7 caused by the minute vibrations of the position of web 1 does not greatly influence the coating amount. Further, in this process, coating and metering can be conducted using a single bar 7 with a small diameter, and hence the coating equipment can be much smaller and more compact as compared with the equipment in a conventional bar coating process and only one air cushion device 6 is needed. Thus this process is extremely advantageous from the point of view of space required.

In order to form and maintian liquid pool 12 in a steady state, coating solution amount $Q_1$ to be picked up by bar 7 must be the same as or greater than the coating solution amount $Q_2$ to be coated on web 1. In general, when $Q_1 > Q_2$, the input of coating solution 2*b* to liquid pool 12 is greater than the output therefrom. Therefore, in maintaining the amount of liquid pool 12, excess coating solution is allowed to flow out of liquid pool 12. That is, part of coating solution 2*b* scraped away by bar 7 flows over dam member 10, and flows down along the outer surface of dam member 10. Thus overflowing coating solution 2*b* flowing downward is recovered and reused as coating solution 2*b*.

In order to obtain a coating layer with good surface properties by coating while forming liquid pool 12, the quantity of liquid pool 12 must be maintained within a certain range. The appropriate quantity of this liquid pool will vary depending upon various conditions, and hence this quantity should be determined, in fact, experimentally using routine evaluations.

Air cushion device 6 gas-supporting the surface of first coating layer 4*a* of web 1 includes a cylindrical gas-flow drum 13 with both ends sealed with guide plates (not shown). Flow holes 14 are provided on the surface of gas-flow drum 13 only in the area where web 1 covers gas-flow drum 13. A gas is supplied, though not shown, through both ends to gas-flow drum 13.

In FIG. 1, restraining roll 5*b* is provided immediately before the second coating section. This restraining roll 5*b* is not always necessary, but it serves to further reduce longitudinal wrinkles and flapping of the web, and thus advantageous results are obtained.

Web 1 having been thus coated on both sides is subjected to after-treatments such as setting, drying, etc. depending upon the nature of the coating solution.

Needless to say, the present invention is not limited only to the above-described embodiment, and various modifications are possible.

For example, while the first coating in the above-described emboidment is conducted by roller coating, the type of coating process which can be used in the first coating is not particularly limited, since handling of web 1 in the first coating is less restricted. For example, an extrusion coating process, a curtain coating process, a bead coating process, a fountain coating process, etc., can be used. A suitable coating process can be selected depending on the physical properties of the coating solution to be coated, the kind of products to be produced, and the like. It goes without saying that the same coating process as that in the second coating section can be employed.

Second coating solution 2*b*, which is fed to the side of bar 7 in the embodiment described above, does not need to be fed in this manner, but a feeding opening may be provided immediately under bar 7.

When bar 7 is rotated too fast, foam will be formed with certain kinds of coating solutions 2*b* between bar 7 and bar-supporting member 8, and the foam can adhere to the surface of bar 7 to be transferred, in turn, to the surface of the coated layer or stay in the vicinity of the part where bar 7 and the downstream side of web 1 come into contact with each other to form streaks. This foam is considered to be formed as a result of air present between bar 7 and bar-supporting member 8 being rolled in due to the rotation of bar 7. Therefore, in order to prevent this, it is possible to feed coating solution 2b to bar 7 in the downstream side as well, as illustrated in FIG. 3 and allow the coating solution to overflow over dam member 10 to form a foam-preventing liquid pool 15, thus avoiding rolling in air on the upstream side.

Also, coating without circulating coating solution 2b, or operation under the condition of $Q_1=Q_2$, can easily be conducted by maintaining the liquid surface level of the coating solution constant using conventionally known techniques. FIG. 4 shows one example of such a procedure. In FIG. 4, floating element chamber 18 is provided on piping 17 between stock tank 16 and solution-feeding opening 9, and floating element 19 is placed in the chamber, which functions in such manner that, when the liquid level exceeds a certain level, feeding of coating solution 2b from stock tank 16 is interrupted whereas, when the liquid level decreases below a certain level, feeding of coating solution 2b to floating element chamber 18 is re-started.

In addition, air cushion device 6 is not limited only to the device described above, and any of those which can stably maintain a static pressure and uniformly exert a gas pressure so as not to cause drying unevenness or the like on the coating layer can be used. For example, all of the air-blowing devices disclosed in Japanese Patent Publication Nos. 17,853/74, 44,108/74, 19,130/75, 38,737/76, U.S. Pat. Nos. 3,635,192, 3,688,738, etc. can be utilized in the present invention.

The first coating solution is not limited at all in the present invention.

The kind of the second coating solution is not particularly limited, and water, an aqueous solution or organic solvent solution of a high polymer compound, an aqueous dispersion or organic solvent dispersion of a high polymer compound, an aqueous dispersion of a pigment, or the like can be used.

Suitable aqueous solutions or organic solvent solutions of high polymer compounds which can be coated include an aqueous solution or organic solvent solution of gelatin, a polyvinyl alcohol aqueous solution, an aqueous solution of carboxymethyl cellulose, an aqueous solution of a maleic anhydride/vinyl acetate copolymer, an aqueous solution of a copolymer of maleic anhydride, an aqueous solution of an acrylic acid copolymer, an organic solvent solution of a cellulose ester, an organic solvent solution of polyvinyl acetal, an organic solvent solution of polyvinyl chloride or polyvinylidene chloride, an organic solvent solution of polystyrene, an organic solvent solution of a phenol resin, an organic solvent solution of an acrylic resin, etc.

Suitable aqueous dispersions or organic solvent dispersions of a high polymer compound which can be coated include an aqueous dispersion of polyvinylidene chloride, an aqueous dispersion of a styrene-butadiene copolymer, an aqueous dispersion of a methyl or ethyl acrylate copolymer.

Suitable organic solvents which can be used are methanol, ethanol, propanol, butanol, acetone, methyl ethyl ketone, ethylene chloride, methylene chloride, tetrachloroethane, ethyl acetate, butyl acetate, methyl Cellosolve, ethyl Cellosolve, dioxane, phenol, cresol, etc.

Suitable pigments which can be coated as dispersions are koalin, agalmatolite, clay, calcium carbonate, aluminum hydroxide, titanium oxide, etc.

The physical properties of the second coating solution are not particularly limited, either. However, a solution with a low viscosity is preferred, and the viscosity is usually adjusted to about 100 cp or less, preferably 50 cp or less, more preferably 10 cp or less. The lower limit of the viscosity is not limited due to coating properties but, usually, a solution with a viscosity of about 0.1 cp or above is used. The surface tension of the solution is not particularly limited, either. However, a surface tension of not more than 90°, preferably not more than 70°, more preferably not more than 50°, indicated in terms of the contact angle with the web, is suitable for obtaining a good coated surface. Of course, no problem arises with the contact angle of the coating solution when an absorbable material such as paper is coated with the coating solution. The lower limit of the contact angle is 0°.

Webs which can be coated with the process of the present invention include paper, synthetic resin films, synthetic resin-coated papers, synthetic papers, metal plates, etc. Suitable resins for the synthetic resin films, which can be used, are, for example, polyolefins (e.g., polyethylene, polypropylene, etc.), vinyl polymers (e.g., polyvinyl acetate, polyvinyl chloride, polystyrene, etc.), polyamides (e.g., nylon-6,6, nylon-6, etc.), polyesters (e.g., polyethylene terephthalate, polyethylene 2,6-naphthalate, etc.), polycarbonates, cellulose acetates (e.g., cellulose triacetate, cellulose diacetate, etc.), and the like. Suitable resins to be used for the resin-coated papers are polyolefins of which polyethylene is a representative example. An aluminum plate is generally extensively used as the metal plate.

The thickness of the web is not particularly limited either, but a web of a thickness of about 0.01 mm to about 1.0 mm is advantageous in view of handling and general-purpose properties.

The bar which can be used in the present invention includes a wire bar and a grooved bar.

Where a wire bar is used in the present invention, a suitable diameter of the bar ranges from about 6 mm to about 25 mm, preferably from 6 mm to 15 mm. If the diameter is more than about 25 mm, longitudinal streaks tend to be formed in the coating layer, thus a diameter above about 25 mm is disadvantageous. On the other hand, if the diameter is less than about 6 mm, difficult problems are encountered in producing such a wire. Thus, the diameter of the wire is usually 0.07 to 1.0 mm, preferably 0.07 to 0.4 mm. If the diameter of the wire exceeds 1.0 mm, streak pitches on the coating layer surface corresponding to the wire become so great that sufficient leveling does not take place in the subsequent drying step and streaks tend to remain on the coating surface after drying. Thus such a wire is inappropriate. On the other hand, if the wire diameter is less than 0.07 mm, it becomes difficult to make a wire bar by winding such a thin wire and, in addition, problems due to the strength of the wire occur.

The thickness of a coating layer to be obtained by using a wire bar with a specific wire diameter is usually constant, although the thickness differs to some extent depending upon the physical properties of the coating solution. With a wire bar having a wire diameter of 0.07 to 1.0 mm, a coating layer of a wet thickness of about 5 to 100$\mu$ is obtained, whereas with a wire bar having a wire diameter of 0.07 to 0.4 mm, a coating layer of a thickness of about 5 to 40$\mu$ is obtained.

Metals are used as the material of the wire. From the standpoint of corrosion resistance, wear resistance, strength, etc., stainless steel is most suitable. The surface of the wire may be plated to further improving wear resistance. A hard chromium plating is most suitable.

In using a grooved bar in the present invention, the pitch of the grooves is suitably 0.1 to 0.5 mm, preferably 0.2 to 0.3 mm and, as the cross-section pattern, that approximating a sine curve is particularly suitable. However, the cross-section is not necessarily limited to such a pattern, and different cross section patterns can also be used.

Generally, the grooved bar and the wire bar result in the same amount of coating under the same coating conditions when the hatched area [e.g., as shown in FIGS. 5 (*a*) and 5 (*b*)] per unit length are equal to each other. Accordingly, a suitable grooved bar may be selected from a view of the wire bar on the basis of the relationship therebetween as described above.

Metals are preferred as materials for the bar from the standpoint of corrosion resistance and strength, with stainless steel being particularly suitable.

Metals, in particular, stainless steel, are suitable as the material for the grooved bar from the standpoint of corrosion resistance, strength and wear resistance.

Suitable materials for the bar-supporting member are those materials which have small friction resistance with the bar (or wire with the wire bar) since the bar rotates at a high velocity. Materials for the bar-supporting member preferably used in the present invention, for example, are fluorocarbon resins, polyacetal resins, polystyrene resins, etc. Of these, polytetrafluoroethylene commercially available under the tradename of Teflon (trade name of E. I. du Pont de Nemours & Co. Inc.), a polyacetal resin commercially available under the tradename of Delrin (trade name of E. I. du Pont de Nemours & CO. Inc.), a polyethylene resin with a molecular weight of 1,500,000 to 4,000,000 commercially available under the tradename of New Lite (trade name of Sakushin Industry Co., Ltd.) and polyethylene resin with a molecular weight of 2,000,000 to 5,000,000 commercially available under the tradename of CADCO 1900 (trade name of Cadillac Plastic & Chemical Company) are particularly advantageous from the standpoint of coefficient of friction and strength. Further, those prepared by adding fillers such as glass fibers, graphite, molybdenum disulfide, etc. to these plastic materials can also be used. Still further, it is also possible to first make a bar-supporting member using a metallic material and coating or adhering the plastic materials as described above thereon to thereby reduce the coefficient of friction with the bar. Alternatively, various metals impregnated with such synthetic resins, for example, aluminum impregnated with polytetrafluoroethylene, may also be used for the supporting member.

The quantity of the liquid pool to be formed in the second coating section of the present invention which is suitable will vary depending upon various conditions. This changes depending upon the physical properties, for example, viscosity, of the coating solution, the structure and rotating velocity of the bar, the travelling velocity of the web, or like factors, and hence it is not very important to describe the quantity of the liquid pool itself, but it is rather more practical to discuss how to select these controllable parameters.

Since a number of parameters are complicately interrelated with each other, these conditions should be selected experimentally. Generally speaking, there is a limit to the ratio of the rotating peripheral velocity of the bar, Vb, to travelling velocity of the web, Vw, and it has been observed that the minimum value Vb/Vw providing advantageous results decreases as the viscosity of the coating solution increases, as the diameter of the wire (or, with a grooved bar, the corresponding pitch, depth or width of the flutes) decreases, or as the coating velocity or web-travelling velocity Vw increases. More specifically, when the viscosity of the coating solution is 1 cp to 25 cp, the minimum value of Vb/Vw can be appropriately selected within the range such that Vb is about 2.0 to 41% of Vw with the web-travelling velocity Vw being about 20 to 80 m/min, by using a wire with a diameter of 0.1–0.4 mm. As long as Vb/Vw is greater than the thus determined minimum value, no additional limitations, e.g., as to the nature of the coating layer, etc., exist. However, if Vb becomes too great, the bar tends to be worn and air tends to be rolled in. Therefore, Vb is desirably at a minimum. In the fields where scratches or flaws are serious problems, such as in photographic light-sensitive materials, it is desirable to establish conditions such that there is no relative difference in velocity between the bar and the web, or that Vb/Vw is almost 1.

In the present invention, the uniformity of the first coating layer should not be damaged by the supporting gas on supporting the coated surface with a gas. The degree of fluidity of the coating layer, i.e., the viscosity of the coating solution, the coating amount, the degree of solidification, water absorption, the flow rate of the supporting gas, etc. determines whether the first coating surface is disturbed or not by the supporting gas. In general, the higher the viscosity, the lower the coating amount, the higher the degree of solidification of the coated layer, the greater the water absorption of the web, or the slower the flow rate of the supporting gas, the less the coating layer is disturbed. However, even when a disturbance occurs at the stage of the second coating, it does not matter as long as the coating disturbance disappears by the time drying is completed. Therefore, the disturbance also depends upon a leveling property of the coating layer, and it is very difficult to generally describe every condition. The conditions are best determined experimentally.

In the present invention, the gas to be used for supporting the web can be any gas that does not detrimentally influence, for example, react with, the coating solution or the like, and can be handled without danger, such as air, nitrogen, helium, carbon dixoide, etc. However, from an economical point of view, air is most generally used. In addition, the gas to be used for supporting a web is preferably adjusted so as to serve for after-treatments after drying the first coating layer. For example, in producing photographic light-sensitive materials, it is desirable to use a gas adjusted to a temperature and humidity which accelerate cooling, solidifying and drying of the coating layers comprising photographic emulsions.

According to the present invention, a coating layer can be provided on the opposite side of a web to the already coated surface before the first coating layer has completely dried without a coating unevenness such as longitudinal streaks occurring, and hence products with high quality can be produced with high productivity.

In addition, this invention enables a consecutive coating of both sides of a web using extremely compact equipment.

The present invention will now be illustrated in greater detail by reference to the following non-limiting examples to further clarify the effects of the present invention.

EXAMPLE 1

On the surface of a 180μ-thick, 1000 mm-wide polyethylene terephthalate film was coated a coating solution, having the composition and physical properties shown in Table 1, in an amount of 8 cc/m$^2$, using an improved bar coating apparatus shown in FIG. 2 without backing up the back side of the web while varying the coating velocity at 25 m/min and at 80 m/min.

A wire bar and a wire made of a stainless steel with a diameter of 12.7 mm and 0.1 mm, respectively, were used, and the wire bar was rotated at the same peripheral velocity as the coating velocity. The material for the bar-supporting member was polytetrafluoroethylene.

Table 1

| | parts by weight |
|---|---|
| Gelatin | 10 |
| Water | 1000 |
| Saponin | 1 |
| Viscosity | 2 cp |
| Surface Tension | 38 dyne/cm |

The thus-formed first coating layer side was supported using a 3000 mm ϕ cylindrical type air-flow apparatus, and the coating solution shown in Table 1 above was coated in a coating amount of 8 cc/m$^2$ on the opposite side using the same bar coating apparatus described above.

This cylindrical type air-flow apparatus had round pores with a porosity of 5% only in the area covered by the polyethylene terephthalate film, and the film was maintained at a distance of 30 mm from the surface of the apparatus. Pressure differences between the inside and the outside of the cylinder were changed in two steps of 1 mm$H_2O$ and 6 mm$H_2O$.

The thus obtained first and second coatings were dried and the surface properties were evaluated. When the pressure difference was 1 mm$H_2$ O, both coating surfaces had good surface quality but, with a pressure difference of 6 mm$H_2O$ where the air velocity was greater, coating unevenness was observed on the first coating layer.

EXAMPLE 2

On the surface of a 100μ-thick, 1000 mm-wide polyethylene terephthalate film was coated a coating solution as shown in Table 2 at a coating velocity of 25 mm/min using the both sides-consecutive coating apparatus shown in FIG. 1.

Table 2

| | parts by weight |
|---|---|
| Copolymer of Dimethyl Terephthalate and Ethylene Glycol/Triethylene Glycol (molar ratio: 2:3:2) | 0.7 |
| Nitrocellulose | 1 |
| Ethylene Chloride | 150 |
| Viscosity | 1.2 cp |
| Surface Tension | 35 dyne/cm |

The first coating was conducted using roller coating by rotating a 175 mm ϕ stainless steel-made roll at 10 rpm in a direction opposite to the film-travelling direction with a coating amount of 20 cc/m$^2$.

The improved bar coating apparatus used in the second coating was the same as used in Example 1, and the coating solution was coated in a coating amount of 8 cc/m$^2$ while maintaining the distance between the gas-flow drum and the web at 30 mm. The cylindrical type air-flow apparatus used in the second coating for supporting the first-coated side was the same as used in Example 1 . The pressure difference between the inside and outside of the apparatus was varied at 0.5 mm$H_2O$ and 2 mm$H_2O$.

After drying the thus-obtained coated layers, the surface quality of the layers was evaluated. Where the pressure difference between the inside and outside of the gas-flow apparatus was 0.5 mm$H_2O$, both coated surfaces had good quality but, where the pressure difference was 2 mm$H_2O$ where the air velocity was faster, coating unevenness was observed on the first coated layer.

While the invention has been described in detail and with reference to specific embodiments thereof, it will be apparent to one skilled in the art that various changes and modifications can be made therein without departing from the spirit and scope thereof.

What is claimed is:

1. A process for consecutively coating both sides of a continuously traveilling web, said process comprising:
   - coating a first coating solution onto a first side of a continuously travelling web, to form a first coated layer thereon,
   - supporting said first coated side of said web by a pressurized gas, and
   - supplying a second coating solution to the second side of said web while said first coated side of said travelling web is supported with said pressurized gas, and while said web is still in a non-dry state, the improvement wherein:
   - said step of supplying a second coating solution comprises:
     - supporting a rotatable bar for rotation about its axis at right angles to the direction of web movement and being peripherally grooved in the direction of bar rotation, for rotating contact with said web on said second side,
     - forming a liquid pool of said second coating solution upstream of said moving web and between said rotating bar and a portion of said web supported by said pressurized gas, and
     - rotating said peripherally grooved rotatable bar at a peripheral speed in excess of the velocity of web movement in the same direction as the travelling direction of said web, to pick up a sufficient amount of said coating liquid to cause said second coating solution to flow onto said second side of said travelling web, over the grooved periphery of said rotating bar to insure evenness and the absence of longitudinal streaks of said second coating on said second side of said travelling web.

2. The process of claim 1, wherein said first coating solution and said second coating solution have a different composition.

3. The process of claim 1, wherein said first coating solution and said second coating solution have the same composition.

4. The process of claim 1, wherein the coating of said first coating solution is by extrusion coating, curtain coating, bead coating, or fountain coating.

5. The process of claim 1, wherein said second coating solution has a viscosity of about 100 cp or less.

* * * * *